United States Patent [19]

Feith

[11] 4,269,163

[45] May 26, 1981

[54] SYSTEM AND APPARATUS FOR PROGRAM CONTROLLED DELIVERY OF GAME BALLS

[75] Inventor: Donald Feith, Elkins Park, Pa.

[73] Assignee: United States Machine Works, Inc., Lansdale, Pa.

[21] Appl. No.: 865,932

[22] Filed: Dec. 30, 1977

[51] Int. Cl.[3] ..... A01B 65/12; A01B 69/38; F41F 1/04

[52] U.S. Cl. ..... 124/77; 273/29 A; 364/410

[58] Field of Search ..... 124/1, 7, 9, 54, 56, 124/59, 71, 72, 73, 77, 78; 273/26 D, 29 A, 85 G, 185 R, 185 A, 186 R; 89/28 R, 41 E, 41 EA, 41 AA, 134, 135; 364/410, 411, 900 MS File

[56] References Cited

U.S. PATENT DOCUMENTS

| | | | |
|---|---|---|---|
| 2,831,402 | 4/1958 | Taslitt | 89/28 R |
| 3,618,456 | 11/1971 | Mindel | 89/134 |
| 3,807,379 | 4/1974 | Vodinh | 273/26 D X |
| 4,008,893 | 2/1977 | Yoseloff | 273/85 G |
| 4,020,407 | 4/1977 | Clement et al. | 89/41 E X |
| 4,021,036 | 5/1977 | Nelson et al. | 273/29 A |
| 4,046,131 | 9/1977 | Clark et al. | 124/71 |
| 4,086,903 | 5/1978 | Scott | 124/78 |

FOREIGN PATENT DOCUMENTS

| | | | |
|---|---|---|---|
| 2355830 | 5/1974 | Fed. Rep. of Germany | 124/7 |

*Primary Examiner*—Richard T. Stouffer
*Attorney, Agent, or Firm*—Morton C. Jacobs

[57] ABSTRACT

An ejector for a sequence of game balls has variable device for setting a different trajectory for each ball and for varying the time interval between each ball delivery. A controller includes an input device used by the tennis player or instructor to enter the court and ball data for each of a sequence of balls; a converter for changing the court and ball data to corresponding trajectory data used in setting the ball ejector; and a digital memory for storing the data for each ball. The controller is switched to a programming mode for setting up the court and ball data for the sequence of balls to be delivered and to an operating mode in which the balls are delivered in accordance with the set program.

19 Claims, 7 Drawing Figures

SYSTEM AND APPARATUS FOR PROGRAM CONTROLLED DELIVERY OF GAME BALLS

BACKGROUND OF THE INVENTION

This invention relates to ball delivery apparatus used in games and particularly to a system for program controlled ball delivery.

Ball delivery apparatus has been used in the game of tennis for practice and instruction. A sequence of tennis balls is ejected from the apparatus to desired areas of the tennis court, so that the player can practice as though playing with an opponent or instructor. Such apparatus has enabled the user to choose the trajectory of each tennis ball in a sequence to simulate the game conditions that he wishes to practice.

It has been found that for most effective use of such apparatus, the user should be able to easily program an entire sequence of play by selecting each location on the tennis court where the ball is to be played and also by selecting the shot type (lob, drive or serve) for the particular ball. To closely simulate actual play for training purposes, the time interval between successive balls of the sequence should be settable in accordance with the distance to be run by the player in going from the play of one ball to the next. Moreover, it would be desirable for training and instruction purposes that the user be able to select from an entire range of conditions calling for player skills going from easy to difficult.

SUMMARY OF THE INVENTION

Accordingly, it is among the objects of this invention to provide a new and improved ball delivery apparatus.

Another object is to provide a new and improved program controlled ball delivery apparatus.

Another object is to provide a new and improved ball delivery apparatus, in which each of a sequence of balls can be delivered to different court locations and with different shot types.

Another object is to provide a new and improved ball delivery apparatus in which the time intervals between successive balls can be varied.

Another object is to provide a new and improved ball delivery apparatus in which the player or instructor programs the sequence of balls by reference to court location and shot type.

Another object is to provide a new and improved system for program controlled delivery of game balls in which the variety of play in a game can be simulated by the player or instructor by program selection.

In accordance with a particular embodiment of this invention, a program controlled game ball delivery apparatus comprises a ball ejector that includes means for setting the trajectories of a sequence of game balls. A controller includes an input device for entering court and ball data signals for each of a plurality of balls, means for converting the court and ball data signals for each ball to data signals for the corresponding ball trajectory, and a memory for digitally storing data signals respectively associated with the sequence of balls. The controller also includes means for operating the trajectory setting means of the ball ejector in accordance with the sequence of stored data signals. The trajectory data signals for each ball control the setting of its trajectory, so that the individual trajectories of the sequence of the balls are established.

In accordance with features of this invention, the memory stores digital data signals for the court location and shot type individually selected for each ball. The memory also stores digital data signals for the individual time intervals between successive shots of the ball sequence, and the controller includes a timer for controlling the firing of the ball ejector in accordance with the stored time-interval data signals.

The input device includes means for developing identifying signals for the court location of each ball in relation to a court diagram having transverse coordinate axes. A keyboard is used for developing signals identifying the different types of shots, including those for lobs, drives and serves.

The controller includes means for transferring from the memory to a signal recorder the sequence of court and shot type data signals stored in said memory, and for subsequently restoring in said memory that recorded sequence of signals when it is desired to practice with the associated sequence of game balls.

BRIEF DESCRIPTION OF THE DRAWINGS:

The foregoing and other objects of this invention, the various features thereof as well as the invention itself may be more fully understood from the following description when read together with the accompanying drawing, in which.

In the drawing corresponding parts are referenced throughout by similar numerals.

DESCRIPTION OF A PREFERRED EMBODIMENT

Figure 1:
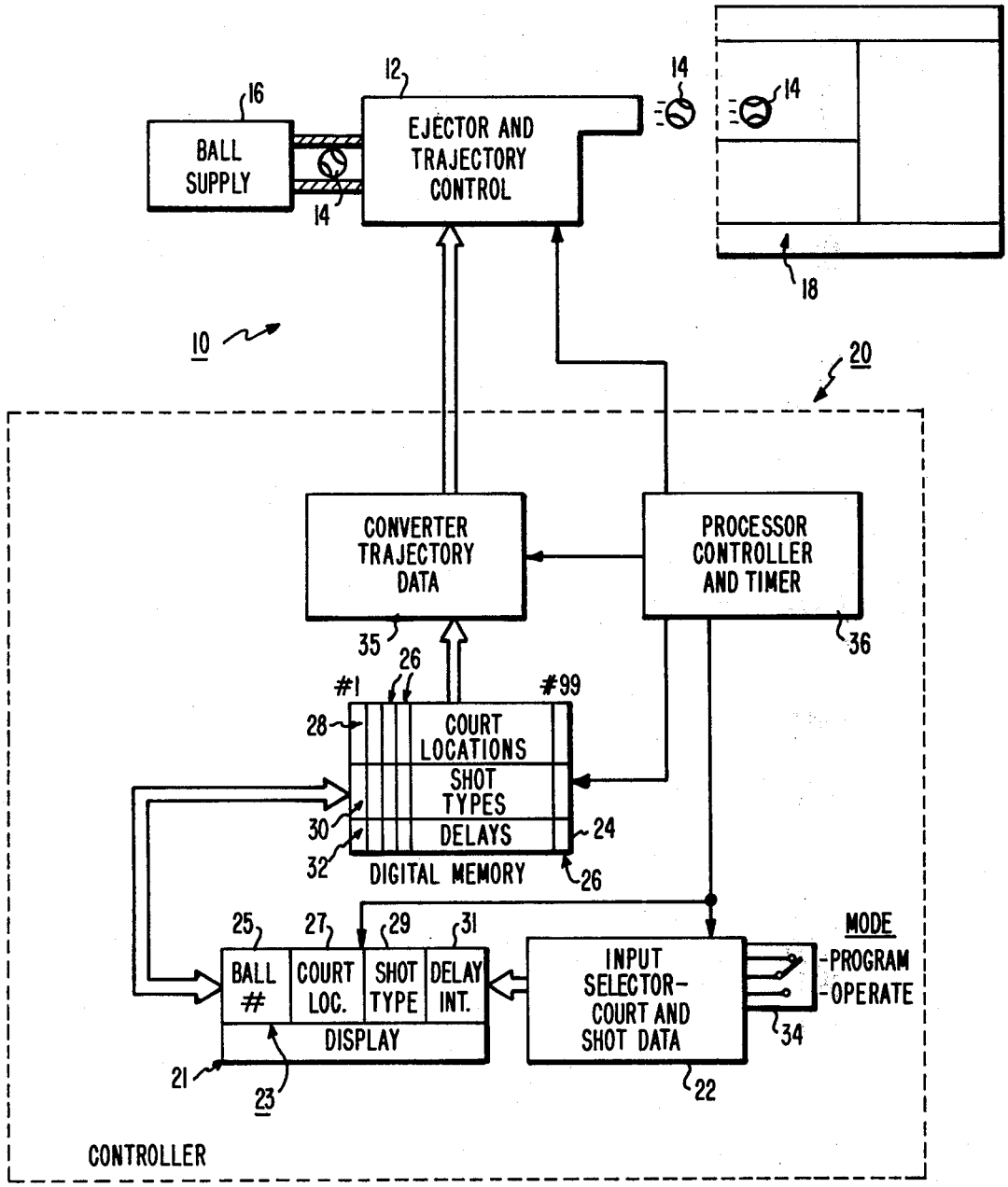
FIG. 1 is a schematic block diagram of a system and apparatus for program-controlled game-ball delivery embodying this invention.

The system and apparatus 10 for program-controlled ball delivery is shown in FIG. 1 and includes a ball ejector device 12 such as for ejecting tennis balls 14. The balls are received from a ball supply 16 such as a ball hopper or other suitable device. The ejector 12 includes a trajectory control that may include a positioning mechanism for the balls as they are fired, so that the tennis balls are thrown out with the proper trajectory to fall at a desired area on the tennis court 18. The positioning mechanism of the trajectory control establishes, for example, the azimuth, elevation and velocity of each tennis ball when it is thrown out of the ejector. The specified area of the tennis court where the ball hits may be any region of the forecourt or the backcourt, and one side or the other.

The ejector 12 receives from a controller 20 the trajectory data for each ball to be ejected. The controller 20 is programmed by the tennis player or instructor by means of an input selector 22 which specifies the tennis court and shot data for each of a plurality of tennis balls to be ejected. The court data identifies the area of the tennis court in which the ball is to fall, the shot data identifies the type of shot, such as lob or drive. The input device 22, operated by the tennis player or instructor, establishes the court and shot data in the form of digital signals which data are visually presented to the operator in a display 21. Thereafter, the operator directs the storage of the signals in a memory 24.

The display 21 has a register 23 with a field 25 for the ball number, a field 27 for the court location, a field 29 for each shot type, and a field 31 for the time interval between each shot and its predecessor. The memory 24 is of the read-write type, e.g. random access, and has a separate storage register 26 for each ball's data; in an illustrative embodiment 99 such registers respectively store the court and ball data for 99 balls in a sequence numbered from #1 to #99. These memory registers are sequentially addressed by the ball number. Each such register is composed of three fields 28, 30, 32; field 28 for the court location data, field 30 for the shot type and field 32 for the time interval.

This memory storage takes place during a program mode of operation of the controller 20 when the input data is being entered; a toggle switch 34 is manually operated to the desired mode. In an operating mode selected by operation of switch 34, the player assumes a position of defensive play on the court 18 and the controller 20 successively controls the delivery of each ball from ejector 12 in accordance with the programmed sequence stored in memory 24. The controller 20 also includes a converter 35 for transposing the digital data signals in the memory registers 26 to corresponding trajectory data signals for use with the trajectory control of the ejector 12. For example, the court and shot data signals are converted to azimuth, elevation and velocity data signals that establish the ball's trajectory.

Overall direction of the system 10 and its controller 20 is provided by a processor and timer 36. In the program mode, the processor controls the transfer of the digital data signals from the input selector 22 to the display register 21, and thereafter to that one of the memory registers 26 corresponding to the particular ball number. In addition, after each ball's data is stored in the memory 24, the ball number in the display-register field 25 is incremented to the next number in sequence. In the operation mode, processor 36 operates successively with the court and shot data stored for the sequence of ball numbers to direct the conversion to trajectory data for each ball, and to direct the use of that data in the ejector's trajectory control. The processor 36 also includes a timer that is reset upon the completion of each cycle of operation, which occurs at the firing operation for the ejection of a ball. The timer (e.g. a digital clock) then starts to count the time for the shot interval of the next ball number stored in its field 32. In that interval, the next ball 14 is loaded in the ejector 12, and its trajectory set up as specified in the data from converter 35, and upon completion of the interval, that next ball is fired.

In a preferred form of the invention, the court and shot data are stored in the digital memory 24 so that upon completion of the program, the player or instructor can successively present each ball's court and shot data on the display device 21 and check that the program is established in the desired form. In another form of this invention, the converter can operate during the entry of input data to establish the trajectory data in digital form and store that trajectory data in a digital memory in association with each of the sequence of balls by sequence number. This converter may be part of the processor 36.

Figure 2:
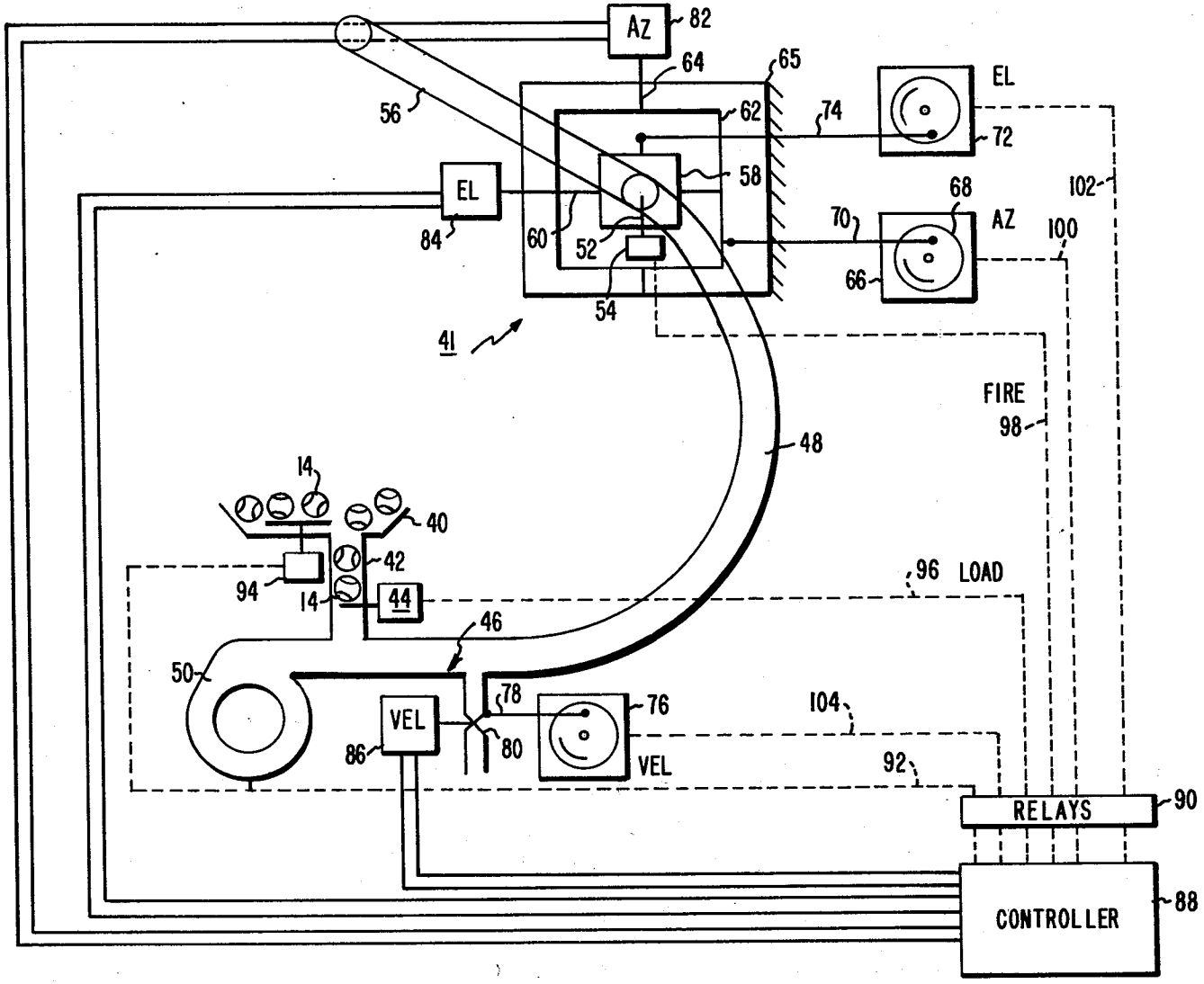
FIG. 2 is a schematic block and system diagram of a particular embodiment of the apparatus of FIG. 1.
Figure 3:
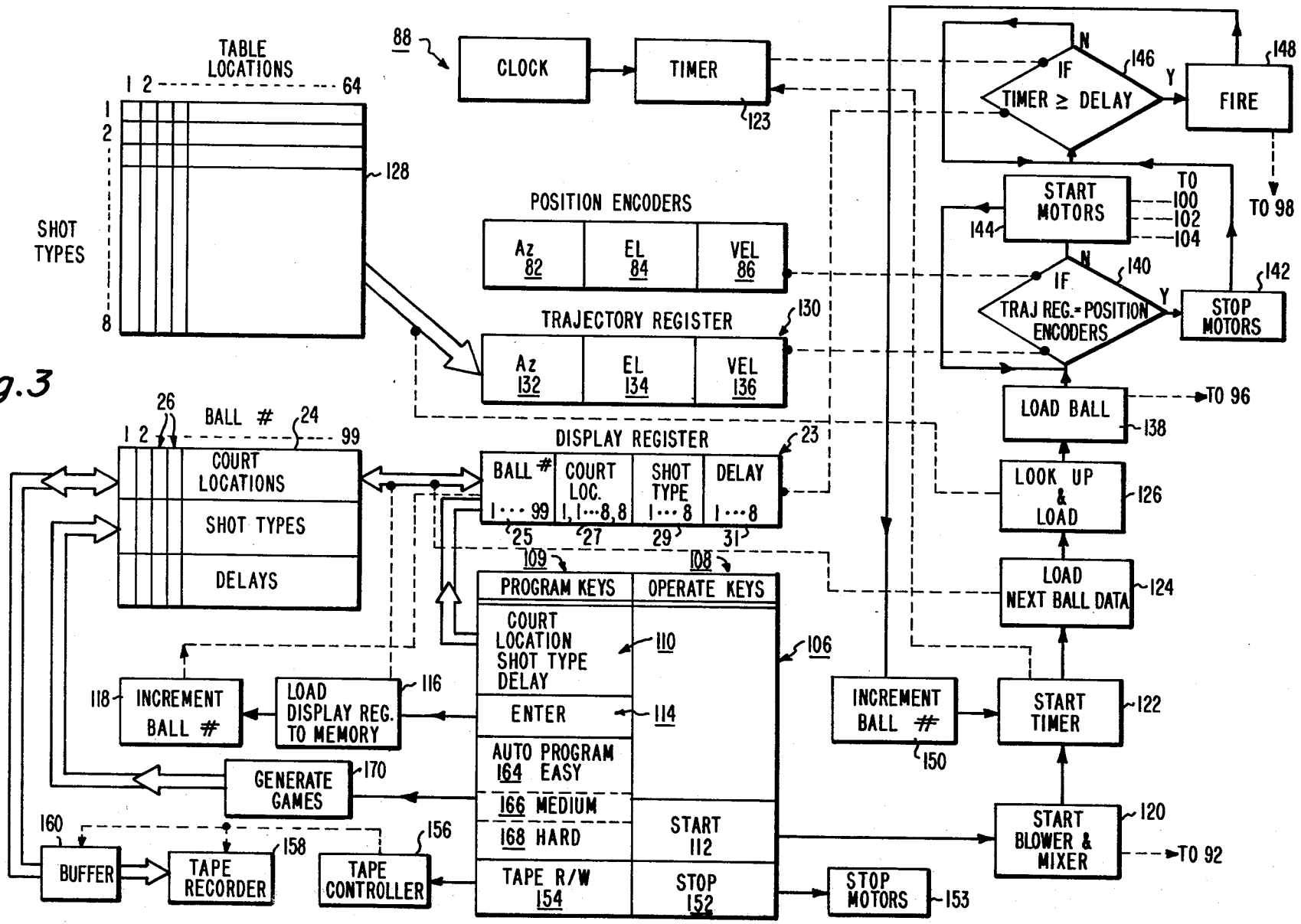
FIG. 3 is a schematic block and flow diagram of the controller of FIG. 2.

In the illustrative embodiment of the invention shown in FIGS. 2 and 3, the ball delivery and control system includes a hopper 40, in which the balls 14 are stored. From hopper 40, the balls 14 are fed one at a time to the ejector 41 through a delivery chute 42, under control of a load solenoid 44, to the pneumatic loading passage 46 that includes a flexible hose 48. A blower 50 supplies air at high pressure to the passage 46 and to a ball 14 retained in the end thereof by a firing pin 52 of a solenoid 54. A generally airtight seal around the ball is provided by a suitable gasket in passage 46 at firing pin 52, where a cannon tube 56 has its loading end sealed to the hose 48.

The cannon 56 from which the ball is fired is mounted on a gimbal ring construction; that is, the loading end of tube 56 is rigidly connected to an inner gimbal ring 58 having a horizontal pivot shaft 60 for positioning the cannon vertically. Pivot shaft 60 is connected to the outer ring 62 which has a vertical pivot shaft 64 connected to the base 65 for positioning the cannon 56 horizontally. An azimuth motor 66 is mechanically linked such as by a cam 68 and offset rigid connection 70 to the outer gimbal ring 62 for moving it about the vertical axis of shaft 64 for specifying the azimuth portion of the trajectory data. An elevation motor 72 is similarly connected via linkage 74 to the inner gimbal ring 58 for rotating it about the horizontal axis of shaft 60 to establish the elevation portion of the trajectory prior to the ball being fired from the cannon.

In this illustrative form of the invention where the driving force for the cannon is pneumatic, the blower 50 continuously supplies air under pressure to the load passage 46. The pressure in the passage 46 is set by a velocity motor 76 which is similarly connected via linkage 78 to a bleeding valve 80 that is closed and opened by the velocity motor 76. Thereby, the latter establishes the firing air pressure within the load passage 46 and the imparting force to the tennis ball 14 when released by the firing pin 52.

The trajectory setting mechanisms in the ejector 41 employ digital encoders 82, 84, 86 for the three motor positions. An azimuth encoder 82 is connected to the vertical-axis shaft 64 of the gimbal and supplies a four-bit digital representation of the shaft's rotary position, which is a function of azimuth. Similarly, the elevation encoder 84 is connected to the horizontal shaft 60 of the gimbal and likewise supplies a four-bit digital representation of its position, which is a function of elevation. The velocity encoder 86 is connected to the shaft of the bleed valve 80 and thereby is adjusted with the valve adjustment by motor 76. Accordingly, the velocity encoder supplies a four-bit representation of the pneumatic pressure in the load passage 46 and feed hose 48, which correspondingly is a function of the ejection velocity. These digital representations of the respective positions of the elevation, azimuth and velocity motors are the trajectory data, which data are also specified by the controller 88 for producing the ball trajectory that corresponds to the specified court location and shot type.

The controller 88 supplies control signals for operating the ejector 41 via relays 90 and initiates operation by supplying power on control line 92 that turns on a motor for the blower 50 and that turns on another motor 94 for mixing the balls in the ball hopper 40, which keeps a flow of balls in the delivery chute 42. The controller actuates the load solenoid 44 via control line 96 and the fire solenoid via control line 98 and the trajectory control motors 66, 72, 76, respectively, via control lines 100, 102 and 104.

Figure 4:
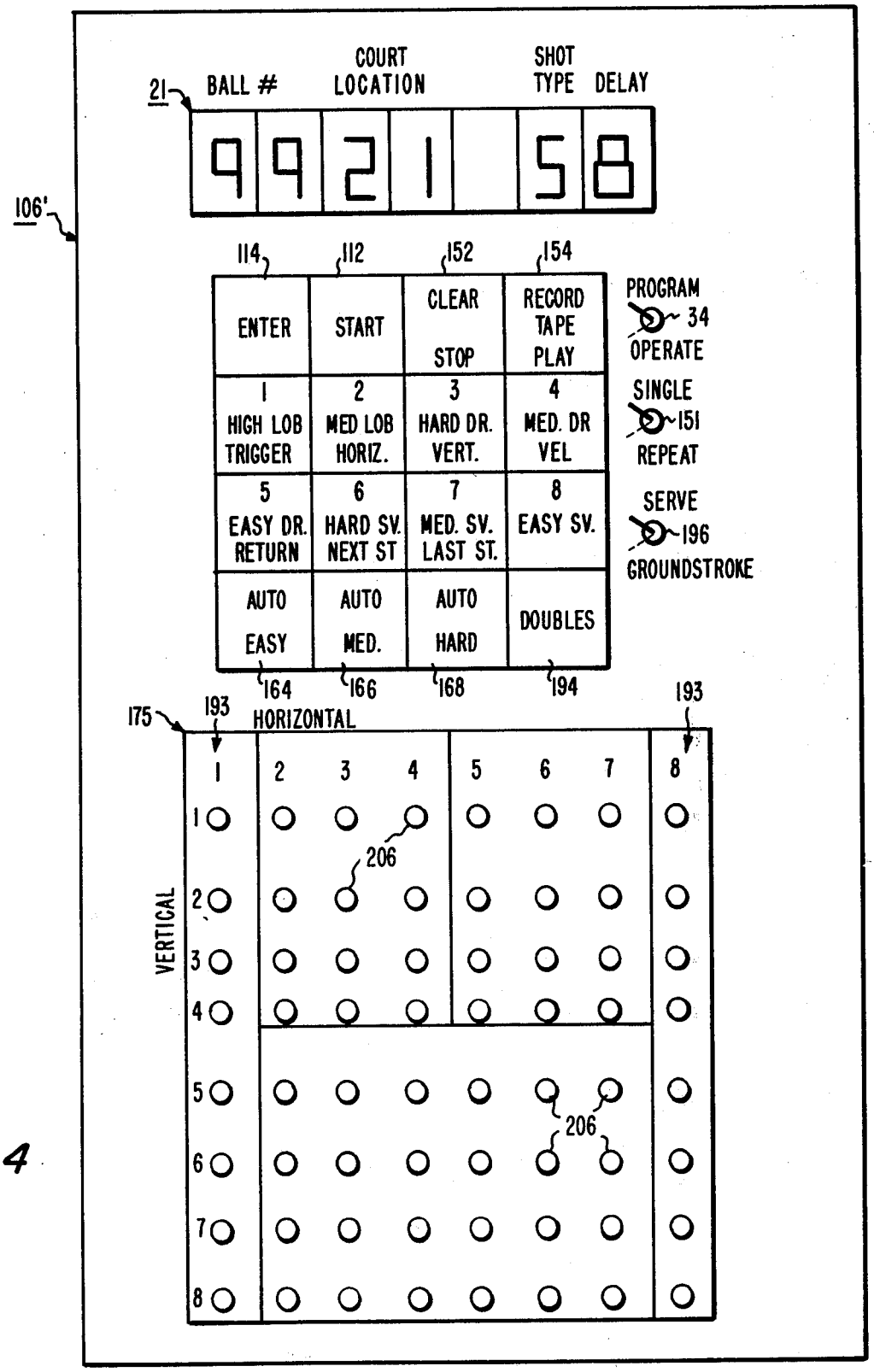
FIG. 4 is a face view of a keyboard used in the controller of FIG. 3.

The controller 88, as shown in FIG. 3, has a keyboard 106 that includes operate keys 108 for the operation of the machine during ball ejection and play, and program keys 110 for entering the ball delivery program. The operate keys include a start switch 112 which is effective when the keyboard is set in the operate mode to carry out the ball-delivery program established previously by the program keys 108 when the keyboard is set in the program mode. The program keys include manually operated switches 110 or similar devices for setting up the court location of each ball, the shot type (lob, drive or serve) and the time delay or interval between successive balls. The interval is chosen by the player or instructor to provide adequate time for the player to travel the distance from the location of the previous shot to that of the currently selected shot. The actuation of these keys 110 establishes the court and shot data in the display register 23 (for visual presentation in the display 21 of FIG. 4) so that the programmer (player or instructor) can check the program data that he is establishing in the machine; a preferred form of keyboard input selector 106' is shown in FIG. 4 and described below. The operator confirms that the display presents the data that he desires to specify for a ball, and then he actuates the enter key 114, which actuates a circuit control 116 to transfer the data set up in the temporary display register 112 to the random access memory 24, described above, to be entered in corresponding fields 28, 30, 32. For each ball, said 1 to 99 balls, corresponding registers 26 of the memory 24 are provided, and within each register, the fields correspond to the court location, the shot type, and the time delay from the previous shot. The address of register 26 is selected in accordance with the ball number in display field 25. When this data has been established in the memory, the controller via circuit control 118 increments the ball-number contents of the field 25 in the display register 23 by one, so that the next ball number is registered and displayed, and the contents of the remaining fields of the display register remain. Thereby, the operator can repeat the same data as for the previous ball by again actuating the enter key 114, or he can key in different data.

The player or instructor proceeds then to select the court and shot data for that next ball number and to actuate the enter key 114 to repeat the programming cycle, and the cycle then is completed by the storage of that data in the appropriate memory location for that ball number and the incrementing-by-one of the ball numbers in the display field 25. This operation then is repeated for as many balls as the player wishes to program in the sequence of 99 possible balls.

Upon completing the program entry, the operator changes the keyboard to the operate mode (by actuating the toggle switch 34, FIG. 4). Having suitably loaded the ball hopper 40 (FIG. 3), the operator actuates the start key 112, and the player goes out on the court. When the start key 112 is actuated, a circuit control 120 generates a signal to start the motor of blower 50 and, at the same time, start the ball mixer motor 94 (FIG. 2) for the hopper 40. The controller 88 operates with computer-type signals (e.g., binary voltages of about 5 volts) which actuate associated relays 90 (a different one for each solenoid and motor) that supply 110 volts a-c for their energization on the control lines 92 and 96–104 (FIG. 4). The operation of the start key 112 can be used to reset the ball-number field 25 in the display register 23 so that the start operation starts with the first ball; alternatively, this reset operation can be omitted except as a certain key is provided to reset it.

Thereafter, the circuit control 122 is actuated to start a timer 123 which begins the cycle of operation that ends with the ejection of the next ball as programmed. The timer 123 counts clock pulses to time the interval following the firing of the previous ball. The circuit control 124 directs the loading of the next ball data into the display register 23 from the register 26 of the random access memory corresponding to the ball number then specified in the display-register field 25. Thus, the court location, the shot type and the delay time are set up in the corresponding fields 27, 29, 31 of the display register.

The next circuit control 126 directs the conversion of the court-location and shot-type data to trajectory data. In this form of the invention, a trajectory look-up table 128 in the form of read-only memory is used. The look-up table 128 has the different possible trajectory data, previously tabulated, stored at memory locations whose addresses are the corresponding court locations and shot types. The table 128, in the illustrative form of the invention has 64 court-location addresses (for the court input of FIG. 4) and 8 shot types (FIG. 4). The contents of display-register fields 27, 29 supply the addresss for table 128 and the contents of that table address are the data signals of the azimuth, elevation and velocity to produce the corresponding trajectory of the ball to be ejected. These data signals, under the direction of control 126, are transferred from table 128 to trajectory register 130, to the respective fields 132, 134, 136.

Thereafter, circuit control 138 loads the next ball by actuating the relay 90 for line 96 to load solenoid 44, so that the next ball passes through chute 42 via an air seal (not shown) and passes through the cannon supply path 46, 48 to the firing pin 52 at the cannon 56.

In the next actuated circuit control 140, the fields 132, 134, 136 of the trajectory register 130 are respectively compared with the corresponding fields of the position encoders 82, 84, 86. If the contents of the encoder's azimuth field 82 are the same as those of the trajectory register's field 132 for azimuth, the azimuth motor 66 is stopped via circuit control 142, the associated relay 9 being actuated thereby to remove power from line 100; similarly, for the other trajectory motors 72, 76. If the contents of any one of the corresponding encoder and trajectory-register fields are not the same, the associated motor is started, via the relay 90 for associated power line 100, 102, 104 under the direction of the circuit control 144. If the azimuth motor 66 is the one that is started, the ejector cannon 56 is thereby rotated about the vertical axis 64 and the output of the azimuth encoder 82 changes accordingly. Similarly, for any other of the motors 72, 76 that is started. Each encoder 82, 84, 86 for a started motor is repeatedly compared (via control loop 140, 144) with the desired trajectory data for that particular motor; and when they are the same, the motor is stopped (via circuit control 142) by actuation of the brake mechanism associated therewith. In one particular form of motor mechanism that is employed, the starting of the motor involves supplying suitable energization thereto, and the stopping of the motor is the removal of that energization with the automatic application of a suitable brake mechanism within the motor. Such motors are well known and commercially available; one form is known as a brake-gearmotor.

When all three motors have stopped, the position encoders 82, 84, 86 are set at the trajectory values in the trajectory register 130, and the cannon tube 56 is positioned and the driving pressure in supply passage 46 and 48 is set to produce the trajectory called for by the court location and shot type in the display register 23. Thereupon, circuit control 146 directs the comparison of the timer register 123 with the delay time set in field 31 of the display register 23. If the timer then indicates a time elapse greater than or equal to the display register's delay time, circuit control 148 directs the firing of solenoid 54, which is energized to retract the firing pin 52 and the ball is ejected from the cannon. The sizes of the pressure-supply passage 46 and flexible hosing 48 are such as to provide an air-reservoir volume and a contracting chamber that maintain the air pressure as the tennis ball is accelerated up the cannon and ejected at the velocity called for to drive the ball into the specified trajectory with an appropriate accuracy.

After this firing operation, the ball-number field 25 of the display register 23 is incremented by one (control 150) and the timer 123 is reset by control 122 to start the timing count for the next time delay. Thereupon, the next ball's court and shot data are loaded into the display register; the data being that associated with the ball number then registered therein. The court and shot data are then converted to trajectory data by obtaining the associated trajectory data from the look-up table 128 for the corresponding court location and shot type and setting it up in the trajectory register 130. Whereupon, the remainder of the cycle is then repeated for that ball in the manner described above.

The data for each ball number in memory 24 is processed in the same way in a similar cycle. A toggle switch 151, in one position, selects a single operating cycle of the ball-program and, in the other position, directs a repeat of the cycle. The repeat operation is initiated when the controller in the operate mode recognizes that the data fields are reset, an initial condition corresponding to the absence of data. Thereupon, the controller resets the ball number to the first ball, and the full program of ball-delivery is recycled. If the hopper 40 should run out of balls, a sensor switch (e.g., in chute 42 at the load solenoid 44) is operated, and the next controller cycle is not initiated until the hopper is replenished. The keyboard 106 also includes a stop switch 152 which actuates a circuit control 153 that directly stops all motors, which the operator may do at any time.

In the program mode, the keyboard is used, via key 154, to initiate a tape recording of the program stored in the random access memory 24. A type controller 156 actuated by switch 154 initiates operation of a magnetic tape recorder 158 and a buffer 160 to transfer sequentially all of the court and ball data from the random access memory 24 to the recorder to be written on a tape preferably in cassette form. Thereafter, in the operate mode, switch 154 acts as a tape-read switch, and when actuated, the court and ball data recorded on the cassette in the tape recorder is transferred, as directed by the tape controller, back into memory 24 at the corresponding ball-number registers 26. Thereby, the program may be recorded along with an instruction presentation by the tennis instructor. That is, the instructor can record on a tape cassette a lecture of the purpose of the lesson and the mode of play by the student. Following his recorded lecture, the instructor can then record on the tape in the manner described above, the particular ball program then stored in the random access memory. The tape controller 156 supplies a leader to the recorded ball program in the form of an identification code in specified digital form, and includes a code recognition circuit which recognizes, on playback, the identification code for opening a gate to pass the digital ball program, via buffer 160, to memory 24. Suitable error checking and recording schemes can be associated with this recording and play back apparatus. Thereby, the student plays the tape to receive the lecture from the instructor and, when the digital ball program is read by the tape controller 156, it recognizes the identification code and passes the program into the random access memory. The ball-delivery apparatus is then programmed for the student to practice the recorded lesson.

For the tape recording, a serial bit stream of two audio tones may be recorded on audio-quality magnetic tape cassettes in a suitable inexpensive tape recorder. Suitable decoding schemes are known for this, one of which is that of a phase-lock loop, which is effective for decoding the binary tones into binary voltage levels with conventional transistor logic. Effectively, each court location is set up as a byte of six binary bits, and the shot type and delay are combined as another byte. The serial bit stream of each byte is set up in buffer 160 to form the parallel data fields. The transfer of these data fields to memory is under the control of the address of the ball number, which is successively incremented. Thereby, the information is sequentially stored in the memory registers 26 (in the appropriate fields) in the same fashion as successive transfers from display-register 23 to memory. For recording on the tape recorder, the operation is reversed. Successive memory locations, starting at ball #1, have their contents read out in the form of two bytes, one of which is for court locations, and the other is for shot types and time intervals. The bytes are set up in parallel in the buffer converter 160 and read out from the buffer serially by bit and recorded as audio tones on the tape recorder. This is repeated for the two bytes that make up the three fields of data for each ball number and for all of the ball numbers from 1 to 99.

Figure 5:
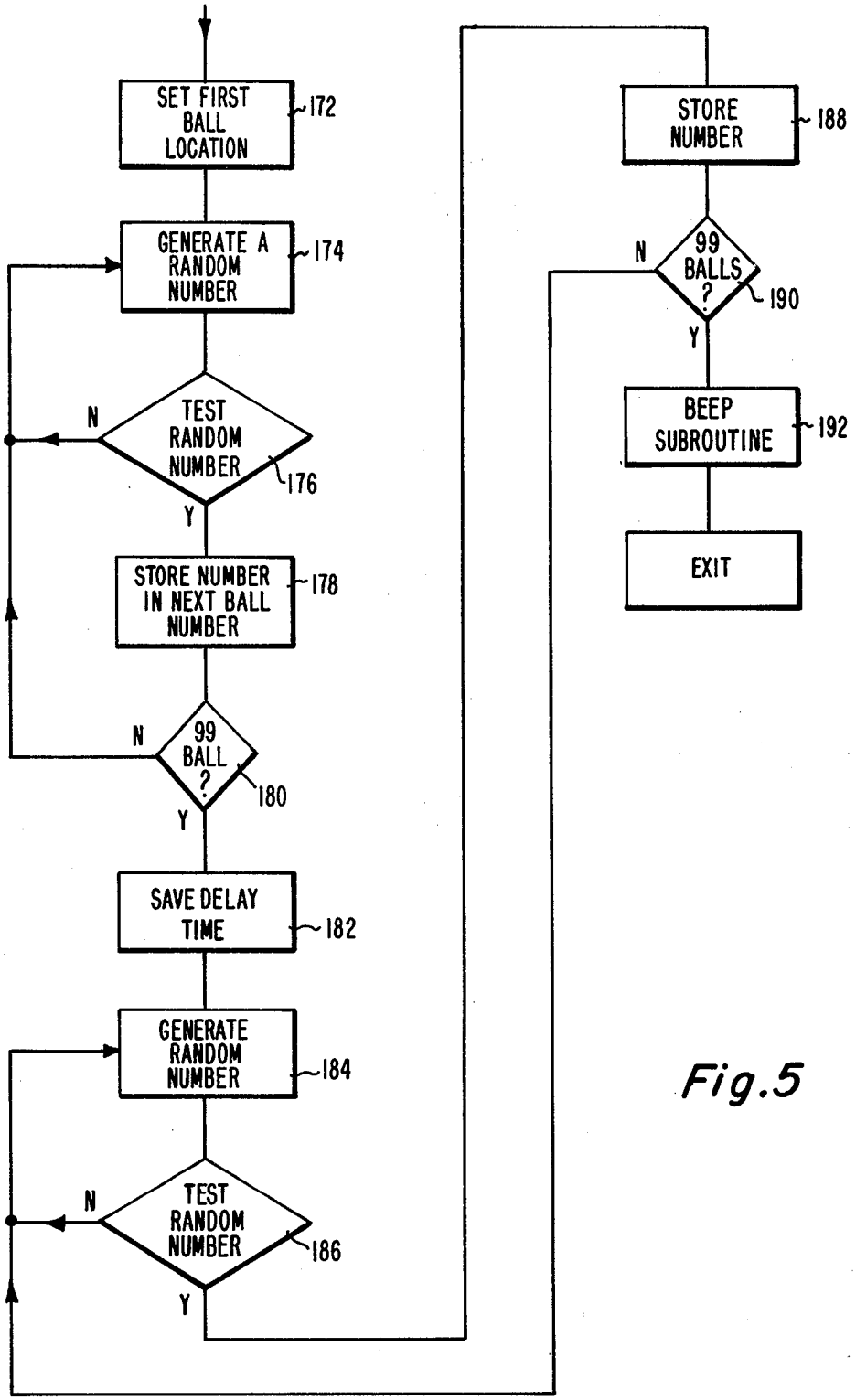
FIG. 5 is a schematic flow diagram of a circuit control used in the controller of FIG. 3.

A group of keys 164, 166, 168 are used to initiate Auto Program in which a circuit control 170 directs the generation and storage of the ball-delivery program on a random basis. To the extent that the generator follows the rules of the game within certain range parameters, it somewhat randomly selects the shot types and the locations on the court. As shown in FIG. 5, the random generator for the ball-delivery program initially sets 172 the court location to 6—6, an arbitrarily chosen initial location for the first ball. Thereafter, a two-digit random number is generated 174 in any suitable fashion, and the generated number is tested 176 for a number of criteria. It must fall within the possible court coordinate-number pairs (e.g., 1—1 to 8—8 in the example shown in the court-diagram selector 175 of FIG. 4).

In addition, the distance on the court between the previous ball location and this location should not exceed the maximum step-length between successive balls for the selected level of difficulty. This test involves the calculation of squaring the difference between ordinates and squaring the difference between abscissas of successive balls, and comparing their sum to another number which is the square of the maximum step-length. For this embodiment, the latter parameter may be 3 for an "easy" program and 7 for a "hard" or "medium." If the random number is within these criteria, that number is stored 178 in the next-ball register 26 in the location field 28. If not, the program returns to generate 174 another random number, and the comparison and decision 176 are repeated. After this store, the next-ball number is incremented to set up the memory address for the next-ball data. This process is repeated in a loop until test 180 shows 99 balls, thereby establishing court locations for all of the balls.

When that is completed, the time interval (set manually by the player into the display register 23 prior to initiating the auto program operation) is saved in a register and is then used for the interval between each ball. The shot types for each ball number also call for generating 184 a random number; The shot type may have single-digit numerals between 1 and 5 in the illustrative embodiment of the invention (e.g., for two lob types and three drives, see FIG. 4). The test 186 of the random number is against a parameter that is prechosen for the specified range of difficulty. If unsuccessful, the cycle is repeated until a successful test 186; whereupon the number is stored 188 in the delay field 32 of the random access memory 24. This cycle is repeated until the test 190 for 99 balls is passed, whereupon the exiting is via a tonal beep signal 192 to let the operator known that the ball program generation is completed.

Figure 6:
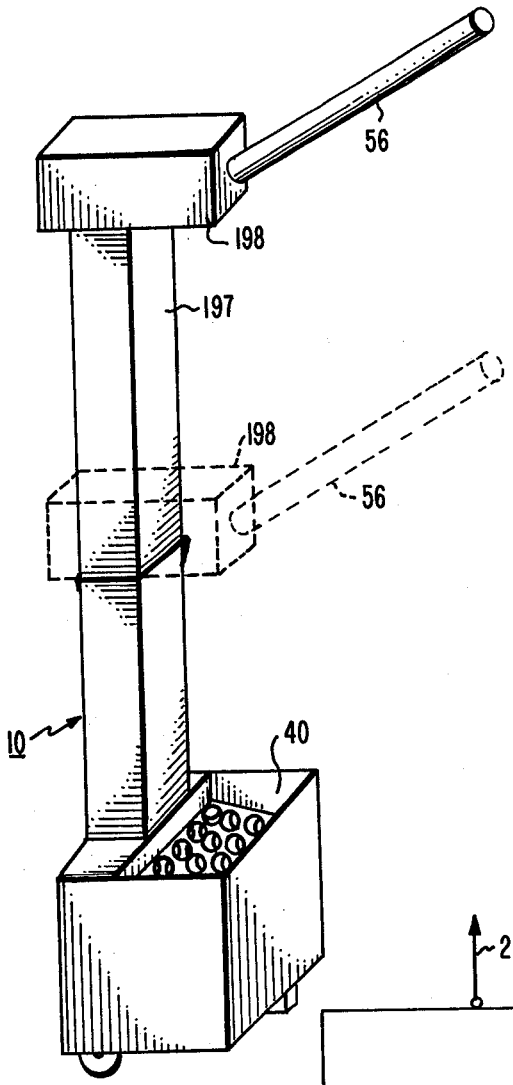
FIG. 6 is a perspective view of the housing for the apparatus of FIG. 2.

In a similar fashion, an auto programming operation can be provided for different levels of difficulty with a suitable change of the test parameters for the court location. For an easy auto program, a hard drive would be excluded as a shot type. If the auto program is for singles play, the court locations in the side alleys 193 (see FIG. 4) are excluded by not permitting number pairs that begin with 1 or 8. Where the doubles switch 194 (FIG. 4) is operated, the range of court locations is correspondingly expanded to include the alley numbers. For an auto program that includes serves, the toggle switch 196 is operated to the serve position, and serves only from an overhead height are generated. In this circumstance, the parameters for testing random numbers are those for location. The court locations are limited to the nine locations within each forecourt section into which serves can be directed, namely, columns 2, 3 and 4 and rows 2, 3 and 4 for the left forecourt, and columns 5, 6 and 7 and rows 2, 3 and 4 for the right forecourt (FIG. 4).

Where serves are programmed, the housing neck 197 of the ejector 41 (FIG. 6) is extended to position the gimbal housing 198 cannon 56 at a suitable elevated position (e.g., about 8 feet high) as shown in full lines in FIG. 6. For groundstrokes, the neck 197 is retracted to position the gimbal housing and cannon at a lower height as shown in broken lines in FIG. 6. The flexible pressure hose 48 accommodates the different lengths between hopper 40 and cannon 56. Where the serves and groundstrokes are to be mixed within the same program, the movement of the gimbal housing and cannon between the two extreme positions is achieved with a motor (not shown) that drives the housing to those positions where a limit switch de-energizes the motor. The shot type code discriminates between groundstrokes and serves to provide the control signals for energization of this motor in a manner similar to that described above.

In the controller 88 of FIG. 3, the transfers of data are shown by double-line arrows. The circuit controls may be individual circuits connected seriatim, so that the completion of the operation of one is used to initiate the operation of the next in sequence. These circuit controls are shown interconnected by single lines representing control signals. The data paths or registers that are controlled or processed are shown connected by broken lines to the circuit controls. In a preferred embodiment of the invention, an inexpensive microprocessor with a suitable stored program dedicated to the control functions has been found to be an advantageous construction considering the present state of the art. However, the invention is not limited in its utility to any particular mode of construction. The programmed microprocessor has been found suitable for constructing the controls with individual routines. A conventional interrupt procedure is used to respond to every keyboard, or other asynchronous, operation so that the system is fully responsive to the operator and to the various operating conditions.

Figure 7:
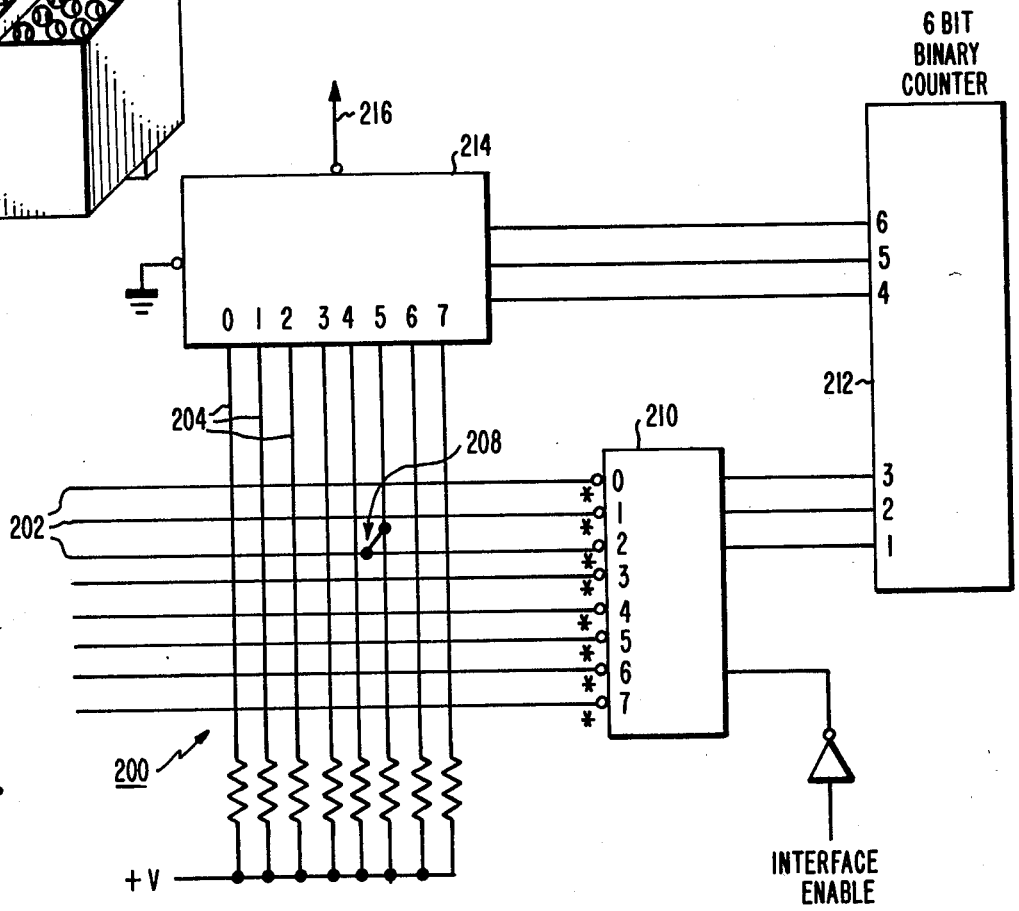
FIG. 7 is a schematic circuit diagram used in the keyboard of FIG. 4.

The court-location selector 175 used in the keyboard of FIG. 4 may employ the circuit shown in FIG. 7. An $8\times8$ switch matrix 200 is employed, in which the horizontal elongated contacts 202 cross over the vertical elongated contacts 204. Each of the 64 keys 206 in the selector 175, when depressed, causes a bridging connection 208 between the associated vertical and horizontal contacts 202 and 204, as shown for the court position 3-1 in FIG. 7. One end of each horizontal contact 202 is floating, and the other end of each is connected to a different output of a BCD-to-decimal decoder, the three lower-stage inputs of which are combinatorially driven from the three lower-order stages of a six-stage counter 212, which is continuously stepped and recycled. The fourth input into the decoder is an "enable" signal via an inverter. One side of each of the vertical contacts 204 is tied to one end of a pull-up resistor, the other end of which receives a suitable operating voltage. The other ends of the vertical contacts 204 are connected to the respective eight inputs of a multiplexer 214, three control inputs of which are the three higher order stages of the counter 212.

In operation, the horizontal lines 202 are successively pulsed as the counter 212 runs through each cycle of the counts of its lower stages, and the actuated connection 208, one time each cycle, has its voltage level change, say, to a high level. Similarly, once each cycle of the three higher stages of counter 212, each multiplexer input is enabled.

When the count established in the six stages of counter 212 correspond to the selected horizontal contact 202 and the selected vertical contact 204, the output line 216 changes from the low to high voltage level. This change in voltage level is then used to read the combination of signals at the six stages of the counter 212, which represents the binary representation of the court location at which the switch key 206 was actuated to close the switch 208. Thereby, each actuation of a key 206 produces a six-bit binary representation of the court location of a ball for storage in memory 24, which representation is the corresponding count established at one point in a cycle of the counter 212.

The operator can review the ball program entered in memory 24 by switching to operate mode and by actuating return key #5 (FIG. 4). This returns the ball number to #1, via a control that resets display register field 25. Actuating next-step key #6, increments the ball-number field 25 and loads the display register with the data from the corresponding memory register 26. Actuating last-step key #7, decrements the ball-number field 25 by one and also loads the display register with the corresponding data from memory.

For manual operation of the system, the operator actuates trigger key 190 1 (FIG. 4) in the operate mode, which starts the blower and mixer, loads a ball and after a short delay, fires the ball. Repeated actuation of this trigger key reloads and refires a ball each time. The horizontal key #1 energizes the azimuth motor 66 and rotates the cannon until key #1 is released for visual positioning of the cannon. Similarly, vertical key #3 is used to visually elevate via motor 72. Velocity key #4 actuates velocity motor 76 so that the operator can manually adjust the velocity. The controller and keyboard may be attached to the lower fixed neck of the housing, or it may be remotely located. Moreover, all or part of the keyboard may be duplicated for remote operation. This manual operation is especially useful for remote control, for example, from the court itself.

Clear button 152 in the program mode initializes the entire contents of memory 24 and resets the ball number in the display-register field 25 to #1; the initializing consists of setting all location fields to 6—6, shot-type fields to $\phi$ (not a valid shot type and representing an end-of-sequence in the operate mode) and the time-interval fields to 3 seconds.

This invention is not limited to the above-described illustrative embodiment, but only as set forth in the attached claims. Other modes of construction will be apparent to those skilled in the art. For example, other mechanisms for ejecting the balls may include counter-rotating wheels, a single wheel and a ramp, a ball platform or lever arm that is actuated by a cocked spring or solenoid. Servo loop techniques may be used for setting the ejecting mechanism to the trajectory data. Other means of entering input data on court location, shot type and shot interval can be a cathode ray tube display and a light sensing pen wherein the CRT is scanned and the sense output of the light pen gives a signal which corresponds to the location of the light pen on the face of the CRT with reference to a court diagram, a shot-type diagram and an interval table or diagram. Other matrix means wherein a row and column signal output is obtained upon actuation may be used for generating court-location data. Other keyboards may be used; for example, a numerical keyboard may be used to enter the court-location numbers chosen by reference to a court diagram. Another means for entering input data uses a voice decoder wherein the operator talks into a microphone and a processor decodes the voice messages into input data signals. Other devices that may be used for recording the ball-delivery program from the memory, and reading it back are a magnetic disk system, or magnetic cards, or punched paper tape, or punched cards, or any non-volatile semiconductor memory such as electrically alterable read-only memories, bubble memories, and programmable read-only memories.

Accordingly, this invention provides a new and improved system and apparatus for programmed ball delivery, in which the balls have different court locations, shot types and time intervals, and in which the player or instructor can select the court and ball data and program the apparatus.

What is claimed is:

1. Program controlled game ball delivery apparatus comprising:

means for successively ejecting a plurality of game balls, including means for setting the trajectories of said balls; and a controller including:

an input device for entering court and ball data signals for each of a plurality of balls, said input device including means displaying a tennis court diagram having a multiplicity of court locations distributed over said diagram corresponding to actual positions on a tennis court where an ejected ball would first hit for each of the different ball trajectories, and means for selecting one of said court locations for each ball and for developing electrical identifying data signals for the selected court location, said selecting and signal developing means including a multiplicity of separate manually operated switch means at said respective court locations, means for converting said court location and ball data signals for each ball to data signals for the corresponding ball trajectory, memory means for digitally storing data signals respectively associated with a sequence of balls, and means for operating said trajectory setting means in accordance with the trajectory data signals for each said ball so as to set a sequence of individual ball trajectories in accordance with said sequence of stored data signals, whereby the operator merely selects the ball type and a court location for each delivered ball to hit on an associated tennis court and the apparatus establishes the corresponding trajectory to deliver the ejected ball thereto.

2. Game ball delivery apparatus as recited in claim 1, wherein said memory means includes means for storing data signals for court location and shot type associated with each said ball.

3. Game ball delivery apparatus as recited in claim 2, wherein said memory means further includes means for storing data signals for time intervals between successive shots of said ball sequence.

4. Game ball delivery apparatus as recited in claim 3, wherein said controller further includes timing means for controlling the actuation of said ball ejecting means for each ball of said sequence in accordance with the associated stored time-interval data signals.

5. Game ball delivery apparatus as recited in claim 2, wherein said memory means stores said court location and shot-type data signals, and said data converting means includes look up table means for storing separate trajectory data signals for different combinations of said court locations and shot types.

6. Game ball delivery apparatus as recited in claim 2, wherein said input device includes keyboard means for developing different shot-type identifying signals for lobs and drives.

7. Game ball delivery apparatus as recited in claim 6, wherein said keyboard means further includes means for developing different shot-type identifying signals for serves.

8. Game ball delivery apparatus as recited in claim 7, wherein said ejecting means includes a housing adjustable between two elevations for respectively delivering serves and groundstrokes.

9. Game ball delivery apparatus as recited in claim 1, wherein said trajectory setting means includes means for individually aiming each ball of said sequence, and means for individually setting the velocity of each said ball.

10. Game ball delivery apparatus as recited in claim 7, wherein said aiming means includes separate means for setting the elevation and azimuth for each said ball.

11. Game ball delivery apparatus as recited in claim 9, wherein said aiming means includes motor means for changing the initial direction of travel for each said ball from said ball ejecting means, and means for establishing a digital representation of said direction of travel; and said means for operating said trajectory setting means includes means for operating said motor means to change said direction of travel until said digital representation thereof corresponds to said trajectory data signals.

12. Game ball delivery apparatus as recited in claim 1, wherein said court-location signal identifying means includes means for developing signals representative of court locations in relation to transverse coordinate axes.

13. Game ball delivery apparatus as recited in claim 11, wherein said court-location signal developing means includes means for developing different electrical signals at different locations of a court diagram.

14. Game ball delivery apparatus as recited in claim 1, wherein said input device includes a digital signal recorder for supplying to said memory means a sequence of court and ball data signals associated with a sequence of game balls to be ejected.

15. Game ball delivery apparatus as recited in claim 13, wherein said controller includes means for transferring from said memory means to said signal recorder said sequence of court and ball data signals.

16. Game ball delivery apparatus as recited in claim 1 includes means for automatically generating said court and ball data signals for a plurality of balls.

17. Game ball delivery apparatus as recited in claim 16 wherein said automatic generating means includes means for generating random data within the parameters of the game.

18. Game ball delivery apparatus as recited in claim 1 wherein said multiplicity of switch means includes a matrix of separate switch elements each respectively associated with one of said switch means, and said selecting and developing means further includes a digital circuit connected to said matrix of switch elements for generating different data signals for each of said switch means when operated.

19. Game ball delivery apparatus as recited in claim 18 wherein said switch elements are distributed in rows and columns over said court diagram, and said digital circuit is connected in common to both the rows and columns of said switch means.

* * * * *